US006189726B1

(12) United States Patent
Fick

(10) Patent No.: US 6,189,726 B1
(45) Date of Patent: Feb. 20, 2001

(54) TOWEL DISPENSER ADAPTER

(75) Inventor: Mike Fick, Sheboygan, WI (US)

(73) Assignee: Binkowsky, Inc., Sheboygan, WI (US)

( * ) Notice: Under 35 U.S.C. 154(b), the term of this patent shall be extended for 0 days.

(21) Appl. No.: 09/306,337

(22) Filed: May 6, 1999

(51) Int. Cl.[7] ..... B65G 59/00
(52) U.S. Cl. ..... 221/1; 221/44
(58) Field of Search ..... 221/1, 33, 44, 221/45, 47, 63, 280; 206/812

(56) References Cited

U.S. PATENT DOCUMENTS

| | | |
|---|---|---|
| 3,433,544 | 3/1969 | Monyette et al. . |
| 3,597,032 | 8/1971 | Harangozo . |
| 4,289,262 | 9/1981 | Finkelstein . |
| 4,811,878 | 3/1989 | Horinchi . |
| 4,905,686 | 3/1990 | Beane et al. . |
| 5,074,430 | 12/1991 | Roberts . |
| 5,131,561 | 7/1992 | Casperson et al. . |
| 5,154,496 | 10/1992 | Campbell et al. . |
| 5,211,308 | 5/1993 | Decker et al. . |
| 5,246,137 | 9/1993 | Schultz et al. . |
| 5,322,186 | 6/1994 | Frazier et al. . |
| 5,577,634 | 11/1996 | Morand . |

OTHER PUBLICATIONS

SCA Hygiene Paper Product Information.

*Primary Examiner*—Kenneth W. Noland
(74) *Attorney, Agent, or Firm*—Brian G. Gilpin; Godfrey & Kahn, S.C.

(57) ABSTRACT

A towel dispenser adapter converts an existing folded towel dispenser to a center-pull towel dispenser. The adapter detachably mounts center-pull towel dispensing heads to an existing folded towel dispenser. The mostly-flat shaped adapter has at least one generally circular aperture therethrough. Each aperture has receiving slots that accept and lock into place the corresponding feet of the dispenser head. The adapter is detachably mounted to the underside of the existing folded towel dispenser and allows towels to be dispensed by a center-pull method.

10 Claims, 3 Drawing Sheets

TOWEL DISPENSER ADAPTER

FIELD OF THE INVENTION

This invention relates generally to towel dispensers and, more particularly, to an adapter for converting a folded paper towel dispenser to a center-pull towel dispenser.

BACKGROUND OF THE INVENTION

A number of dispensers exist for dispensing paper toweling and the like. Some of these dispensers are of the folded type, wherein towels are pulled from the bottom of a stack through an elongated longitudinal slot in the dispenser. Other dispensers are of the "center-pull" type, wherein toweling or other sheet material may be pulled from the center of a coreless roll through a nozzle, a pair of rollers, or other restrictor element forming a restricted passageway. U.S. Pat. No. 5,246,137 to Schutz et al. and U.S. Pat. No. 5,577,634 to Morand, the disclosures of which are incorporated herein by reference, disclose a center-pull roll product dispenser with nozzle inserts, and a paper towel dispenser for dispensing towelling from the inside diameter of a roll, respectively.

Several problems exist with the folded towel dispensers in regards to waste and sanitation. For example, many such dispensers have wide dispensing orifices that allow the user to pull out more paper towels than needed, thus leading to considerable waste, as well as unnecessary cost to the towel provider. In addition, there is more cleanup involved since many of the wasted paper towels are not properly discarded. Further, because a user may be able to reach and touch undispensed towels, which may be subsequently used by another, potential problems concerning cleanliness and hygiene exist.

Also, efficiency problems exist with the folded dispensers when compared to center-pull dispensers. First, with center-pull dispensers there is generally a capacity for more sheets to be placed into the dispenser. Also, with center-pull dispensers, refill becomes more efficient, both because of the increase in the number of sheets allowed per dispenser, as well as the ease of replacement of the rolls compared to stacks of individual sheets.

Often a towel provider will have installed folded towel dispensers and then come to realize some or all of these problems. However, once a towel provider has purchased folded towel dispensers and placed them into use, it is a costly process to install an entire new set of center-pull dispensers to alleviate the above-mentioned concerns.

Accordingly, a need exists for an adapter that allows center-pull towel dispensing heads to be used with existing folded towel dispensers, such that the entire existing towel dispenser does not have to be replaced.

OBJECTS AND SUMMARY OF THE INVENTION

Therefore, it is an object of the present invention to provide an adapter capable of converting a folded towel dispenser into a center-pull towel dispenser. It is an additional object of the present invention to provide an adapter that accepts existing center-pull dispensing heads and that detachably mounts to the underside of an existing folded towel dispenser to convert the folded towel dispenser into a center-pull towel dispenser. It is a further object of the present invention to provide a towel dispenser adapter that overcomes the disadvantages of the prior art and is cost effective.

The adapter of the present invention provides the above-mentioned and many additional objects by providing a towel dispenser adapter that has at least one (usually two) generally circular apertures therethrough. The apertures each have L-shaped receiving slots that accept the corresponding feet of the center-pull dispenser head. Existing center-pull dispenser heads, such as the one marketed by SCA Hygiene Paper under the name M-Pro, typically have four locking feet, although other numbers may be used. The dispenser head feet are inserted into receiving slots in the adapter, and the dispenser head is rotated to lock the feet in place. The adapter is a mostly flat-shaped plate that is detachably mounted to an existing folded towel dispenser through the elongated longitudinal slot portion using a mounting bar. To install the adapter, the plate portion is placed against the underside of the existing folded towel dispenser. A bolt is inserted upward through a hole in the plate, through the elongated longitudinal slot portion of the dispenser, and through a mounting bar placed inside the towel cabinet of the existing towel dispenser over the bolt. A nut is then threaded onto the bolt to lock down the mounting bar transverse the elongated longitudinal slot portion to secure the adapter in place beneath the slot portion. When the adapter, with the heads attached, is in place, the existing folded towel dispenser can now be used to dispense center-pull towels.

While the present invention can be used to convert folded towel dispensers into center-pull towel dispensers, it should be noted that the present invention could be adapted for use in converting other types of dispensers to an alternative dispensing method, so as to effectuate the objective of not having to replace the entire existing dispenser.

In sum, the present invention represents a significant improvement over the prior art in many ways. The adapter in accordance with the present invention allows for quick and easy conversion of towel dispensers to an alternative method of towel dispensing, and overcomes the disadvantages of the prior art. These and other objects and advantages of the present invention will become apparent from the detailed description and accompanying drawings.

DETAILED DESCRIPTION

Figure 1:
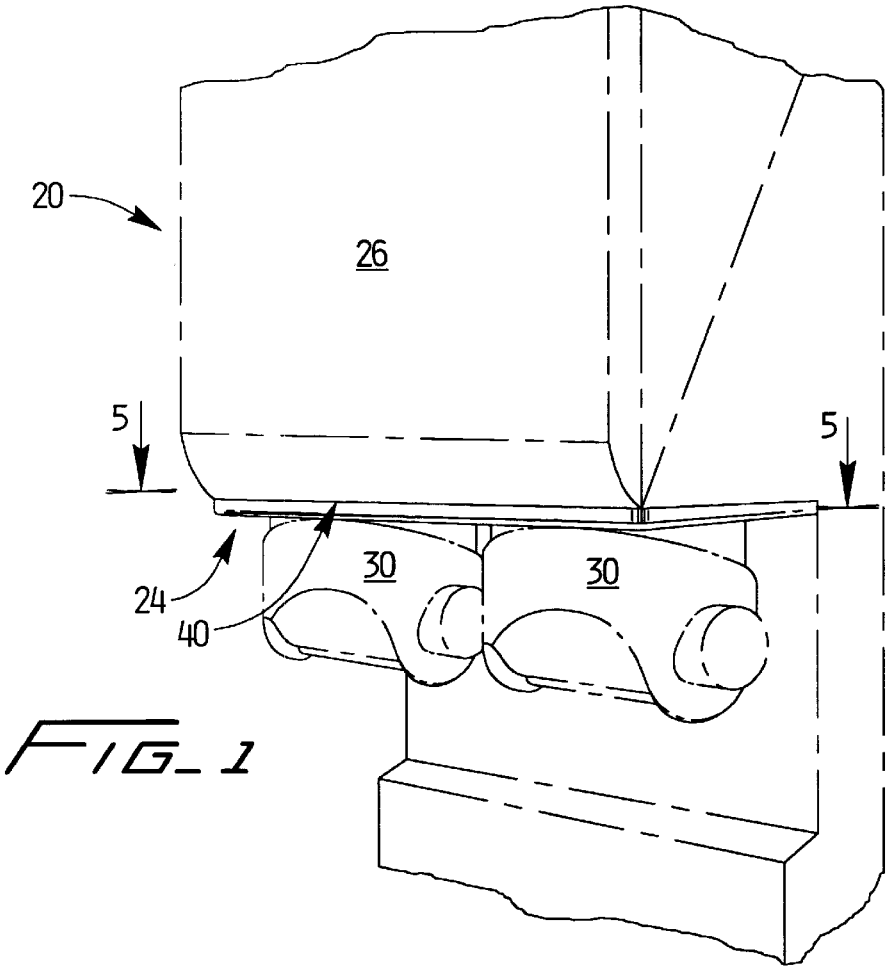
FIG. 1 is a perspective view of a folded towel dispenser (shown in phantom) with an adapter in accordance with the present invention mounted thereon, with center-pull dispensing heads mounted onto the adapter.

FIG. 1 is a perspective view of an existing folded towel dispenser 20 (shown in phantom) with a paper dispenser adapter, identified generally as 40, attached thereto to convert the folded towel dispenser 20 into a center-pull towel dispenser. The adapter 40, with attached center-pull dispenser heads 30, is mounted to the underside 24 of the existing folded towel dispenser 20. The adapter 40 is designed to receive center-pull dispensing heads 30 to allow the center-pull dispensing heads 30 to be mounted to existing folded towel dispensers 20. Thus, existing folded towel dispensers 20 are converted to center-pull towel dispensing machines.

Figure 2:
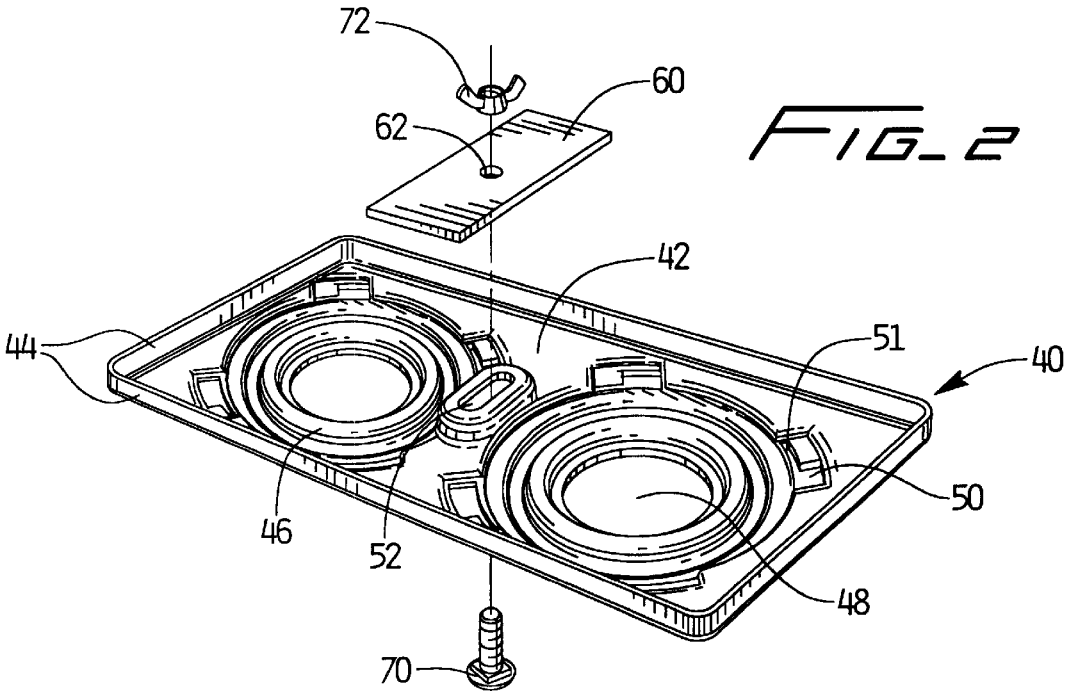
FIG. 2 is a perspective view of an adapter in accordance with the present invention.

As can be seen in FIG. 2, the adapter 40 is mostly a flat-shaped planar surface 42. It is typically rectangularly shaped, with side support ridges 44 that run at approximately right angles to the planar surface 42 of the adapter 40. The outside perimeter of the adapter 40 is generally shaped to match that of the underside 24 of the existing folded towel dispenser 20. If the underside 24 of the existing folded towel dispenser 20 is smaller than the perimeter of the side support ridges 44, the side support ridges 44 may encompass the entire underside 24 of the existing folded towel dispenser 20. However, generally, the perimeter of the side support ridges 44 will be smaller than the perimeter of the underside 24 of the existing folded towel dispenser 20 and will butt up against the underside 24 of the existing folded towel dispenser 20. An adapter 40 that snugly fits around the underside 24 of the existing folded towel dispenser 20 can assist in holding the adapter 40 and dispensing head 30 in place, and to aid in the overall stability of the device.

The adapter 40, although generally plate-like in shape, may contain ribbing 46 to add structural strength. As can be seen clearly in FIG. 4, concentric ribbing 46 exists radiating outward from each circular aperture 48. The ribbing 46 continues outward until the receiving slots 50. While more costly, one alternative design is for the adapter to be a completely solid piece milled out of a solid block, with receiving notches for the dispensing head 30 feet.

One method of manufacturing the adapter 40 is vacuum forming a sheet of plastic. The formed part is then hand machined to provide the desired apertures. Alternatively, the adapter 40 may be injection molded.

In one embodiment of the invention, as shown in FIG. 2, the adapter 40 has two generally circular apertures 48 therethrough. Each aperture 48 is cut to adapt to the corresponding shape of the towel receiving passageway of the center-pull dispenser head 30. The aperture 48 allows the towels to be pulled freely from the towel dispenser 20, through the aperture 48 in the adapter 40, and through the dispensing head 30 towel receiving passageway as necessary.

Figure 3:
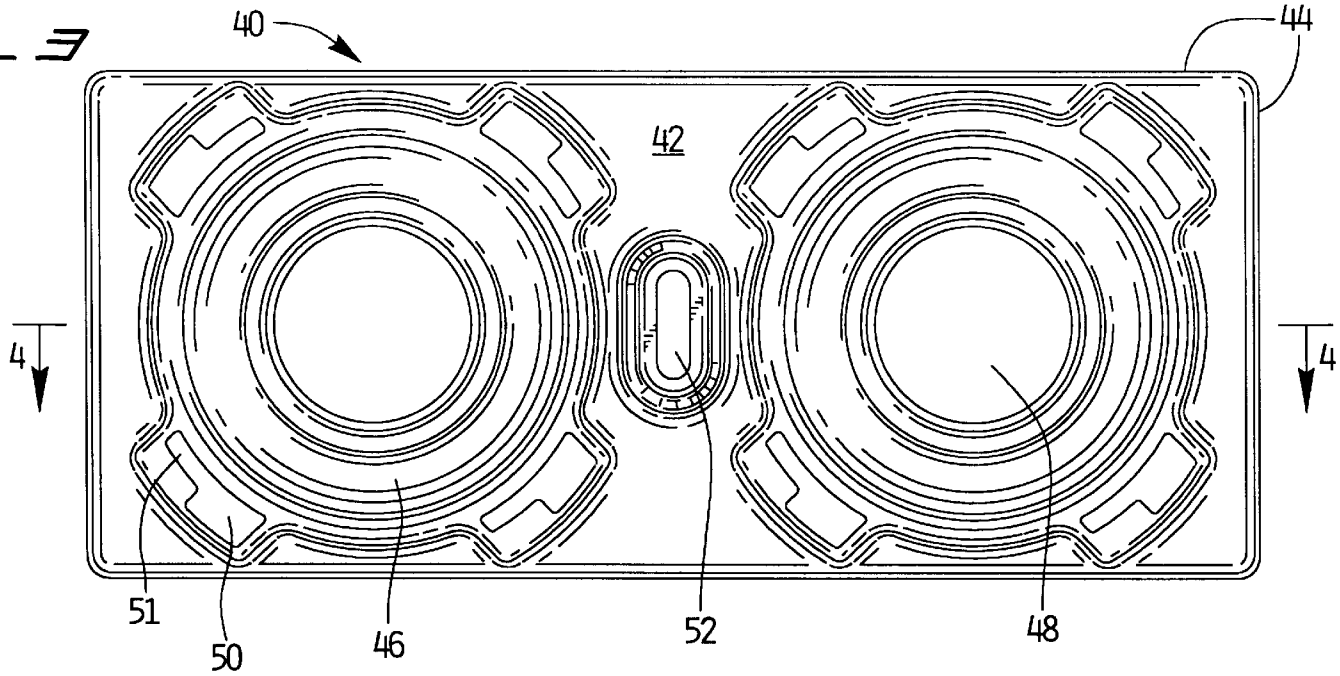
FIG. 3 is a top view of the adapter of FIG. 2 with the mounting bar removed.

Center-pull dispenser heads 30 generally have four feet spaced evenly around their circumference. Consequently, each of the apertures 48 cut into the adapter 40 have four L-shaped receiving slots 50 located at its circumference, as can be seen clearly in FIG. 3. The receiving slots 50 are positioned and shaped to correspond to the location, size, and shape of the dispenser head's 30 feet. Thus, the number and location of the receiving slots 50 should be adjusted to accommodate the particular dispensing head 30 used. The size of the receiving slots 50 should be sufficiently large to allow for the insertion of the feet of the dispenser heads 30 into the receiving slots 50. The dispenser head 30 feet are inserted into the corresponding receiving slots 50 in the adapter 40. As previously described, the receiving slots 50 are L-shaped. Therefore, the additional cut out portion 51 of the L-shape in the planar surface 42 of the adapter 40 allows the dispenser head 30 to be rotated to lock its feet in place and securely attach the dispenser heads 30 to the adapter 40. Although this embodiment is a plastic plate-like adapter 40 with two dispenser heads 30 disposed therefrom, an alternative embodiment could be a one-piece molded construction which includes both the planar surface 42 of the adapter 40 and at least one dispenser head 30.

The adapter 40 also has cut into it a hole 52 of adequate size to receive a bolt 70 for mounting purposes. The location of the hole 52 is such that when the adapter 40 is mounted into place by sliding its side support ridges 44 either up against or around the underside 24 of the existing folded towel dispenser 20, the hole 52 is alignable with the elongated longitudinal slot portion 22 of the existing folded towel dispenser 20 through which towels are dispersed. The alignment should be such that a bolt 70 may be inserted upwardly through both the hole 52 and the elongated longitudinal slot portion 22. This is used for securement purposes, as discussed in further detail below.

Figure 4:
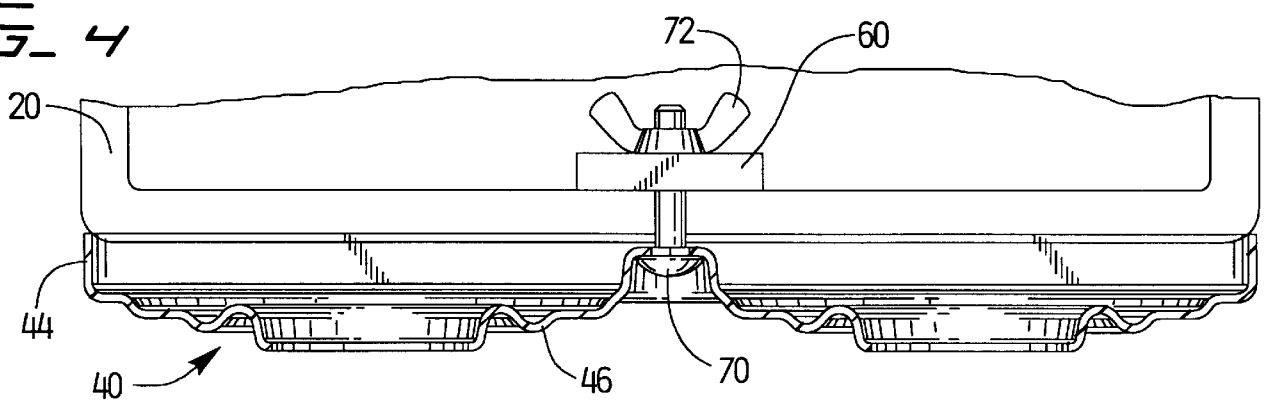
FIG. 4 is a partial cross-section of the adapter of FIG. 3 taken generally along line 4—4, the adapter shown detachably mounted onto the underside of a folded towel dispenser.

Installing the adapter 40 requires only a few easily completed steps. The adapter 40 is placed against the underside 24 of the existing folded towel dispenser 20, as shown in FIG. 4. A bolt 70 is inserted upwardly through the hole 52 in the adapter 40, through the elongated longitudinal slot portion 22 in the dispenser 20, and then through a mounting bar 60 which is positioned inside the towel cabinet 26. A nut 72 is then fastened over the bolt 70 and tightened into place on the mounting bar 60 until secure. Nut 72 is preferably a wing nut as shown in FIG. 4 to facilitate tool-free installation. Of course, other styles of nuts could also be used. This will assist in holding the adapter 40 in place beneath the elongated longitudinal slot portion 22 of the existing folded towel dispenser 20.

Figure 5:
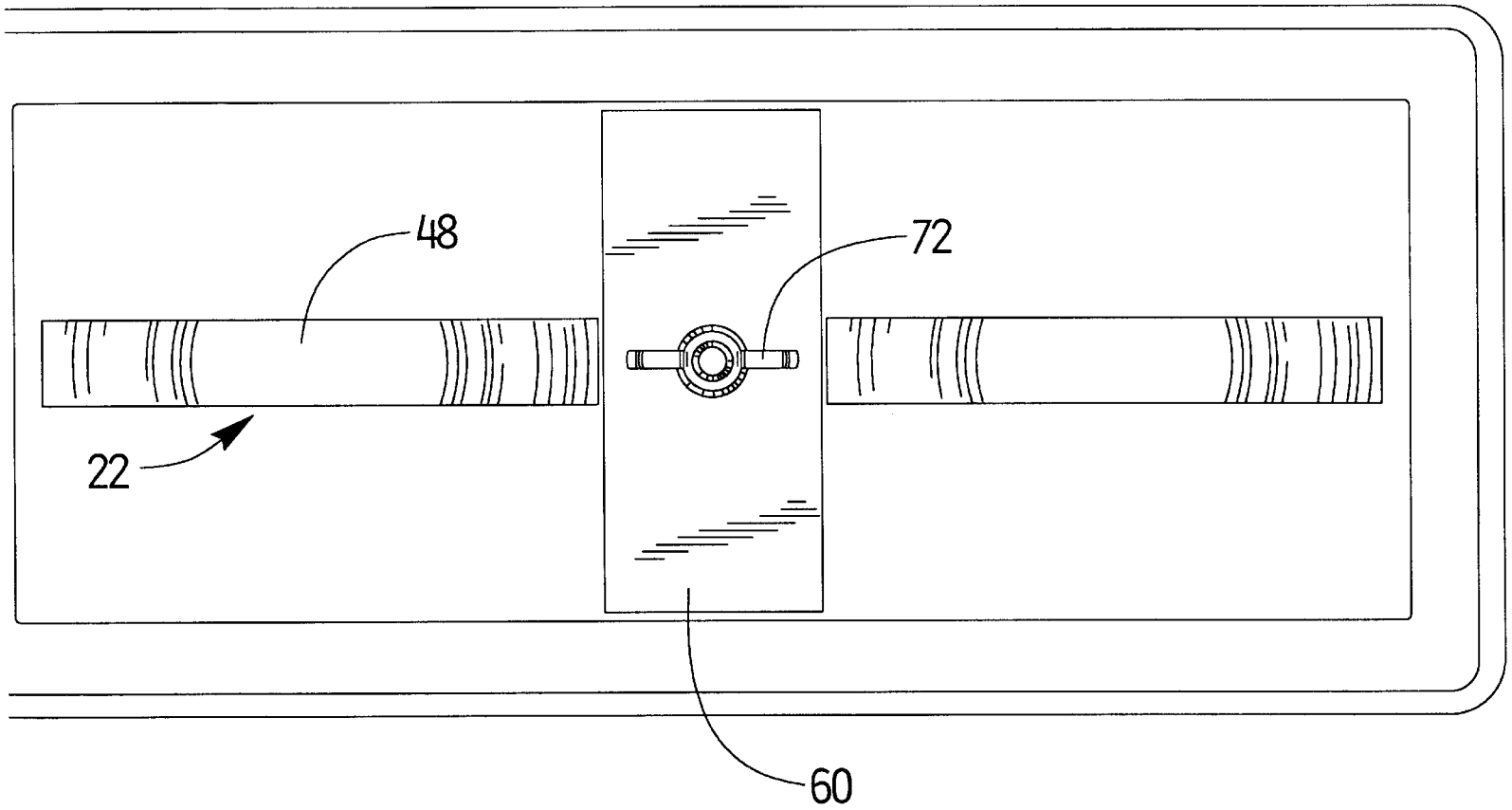
FIG. 5 is a partial cross-sectional top view of the folded towel dispenser of FIG. 1 taken generally along line 5—5 of FIG. 1.

The mounting bar 60 may be made of material such as wood, plastic, or steel, as long as the material's strength is adequate so as to prevent the mounting bar 60 from bowing when the nut 72 is tightened into place. The mounting bar 60 contains an aperture 62 therethrough to accept the bolt 70. As shown in FIG. 5, the aperture 62 must be positioned within the towel cabinet 26 so as to allow the aperture 62 of the mounting bar 60 to align with the hole 52 of the adapter 40 and the elongated longitudinal slot portion of the folded towel dispenser 20.

Although the invention has been herein shown and described in what is perceived to be the most practical and preferred embodiments, it is to be understood that the invention is not intended to be limited to those specific embodiments. Rather, it is recognized that modifications may be made by one of skill in the art without departing from the spirit or intent of the invention. Therefore, the invention is to be taken as including all reasonable equivalents to the subject matter of the appended claims.

I claim:

1. A towel dispenser adapter for converting an existing towel dispenser into an alternative type of towel dispenser, comprising:

a rectangularly-shaped planar surface;

receiving means in the planar surface for receiving an alternative type of towel dispensing head; and stabilizing means for securing the adapter to an underside of the existing towel dispenser.

2. The adapter of claim 1 further comprising at least one aperture in the planar surface through which towels are dispensable.

3. The adapter of claim 2 wherein the stabilizing means further comprises a mounting bar and fastening means for securing the adapter to the underside of the towel dispenser.

4. The adapter of claim 3 wherein the planar surface further comprises ribbing within the planar surface around the at least one aperture.

5. The adapter of claim 4 wherein the planar surface further comprises side support ridges.

6. An adapting apparatus comprising:

an adapter plate formed by a generally plate-like planar surface;

at least one aperture through the adapter plate;

receiving slots in the adapter plate through which a center-pull dispensing head may be mounted; and a mounting bar for mounting the adapter plate in a desired location.

7. The apparatus of claim 6 wherein the receiving slots in the adapter plate are shaped to correspond to a plurality of feet extending from the dispensing head.

8. The apparatus of claim 7 further comprising a bolt and a nut to connect the mounting bar and adapter plate such that the adapter plate is stabilized when mounted in the desired location.

9. The apparatus of claim 8 wherein the bolt is inserted upwardly through a hole in the adapter plate and through an aperture in the mounting bar, the nut being fastened over the bolt to secure the apparatus in the desired location.

10. A method for converting a folded towel dispenser into a center-pull towel dispenser comprising the following steps:

mounting center-pull dispensing heads onto an adapter plate;

positioning the adapter plate proximate a slot in the folded towel dispenser;

inserting a bolt through the adapter plate and through the slot in the folded towel dispenser;

placing a mounting bar over the bolt and transverse the slot; and tightening a nut over the bolt to secure the adapter plate to the folded towel dispenser.

* * * * *